United States Patent [19]

Suzuki et al.

[11] Patent Number: 4,965,997

[45] Date of Patent: Oct. 30, 1990

[54] EXHAUST SYSTEM FOR OUTBOARD MOTOR

[75] Inventors: Tamotsu Suzuki; Toyoshi Suzuki; Takashi Iwashita; Masafumi Sougawa, all of Hamamatsu, Japan

[73] Assignee: Sanshin Kogyo Kabushiki Kaisha, Hamamatsu, Japan

[21] Appl. No.: 833,351

[22] Filed: Feb. 25, 1986

[30] Foreign Application Priority Data

Feb. 27, 1985 [JP] Japan ..... 60-38141

[51] Int. Cl.[5] ..... F01N 7/12

[52] U.S. Cl. ..... 66/310; 60/313; 440/89

[58] Field of Search ..... 440/89; 60/310, 313

[56] References Cited

U.S. PATENT DOCUMENTS 3,813,880 6/1974 Reid .

4,036,162 7/1977 Maier ..... 440/89

*Primary Examiner*—Douglas Hart

*Attorney, Agent, or Firm*—Ernest A. Beutler

[57] ABSTRACT

Embodiments of outboard motors incorporating improved exhaust gas systems for preventing the ingestion of water into the cylinders of an alternate firing multiple chamber internal combustion engine. The exhaust passages are provided with a restricted communication with each other at a point that is above the water under all running conditions so as to prevent water ingestion. In one embodiment, the exhaust passages communicate with an above the water exhaust gas discharge independently of each other and the restricted communication is provided between the passages by a restricted opening in an exhaust pipe. In another embodiment, the exhaust pipe forms an expansion chamber and the individual exhaust passages communicate with this expansion chamber at points close to each other through restricted openings for providing the communication.

5 Claims, 3 Drawing Sheets

EXHAUST SYSTEM FOR OUTBOARD MOTOR

BACKGROUND OF THE INVENTION

This invention relates to an exhaust system for an outboard motor and more particularly to an improved exhaust system that insures against the ingestion of water into the engine chambers under any running conditions.

It is well known in connection with outboard motors to employ a so-called "under the water" exhaust gas discharge for silencing the exhaust gases under high speed running. Where the engine employs multiple cylinders, it has been the practice to employ more than one exhaust pipe and the individual exhaust pipes all communicate with each other at a position that is above the water under normal high speed running. As is well known, however, the degree of submersion of the outboard motor depends upon the speed at which the associated watercraft is traveling. When traveling at low speeds or when idling, the motor is submerged normally to such a point that the common communication between the individual exhaust is beneath the water level. Under this running condition, it is the normal practice to provide an above the water exhaust so as to prevent undue back pressure on the engines. However, with many types of engines, there are conditions under which the exhaust pipe is actually at less than atmospheric pressure. This is particularly true with respect to two cycle engines due to the overlap in the exhaust and intake timing. When the exhaust passage is at a pressure that is less than atmospheric and when the water level in the exhaust pipe is high, there exists a possibility that water may be drawn back into the engine chambers under this condition. This can in some instances cause problems for the engine as should be readily apparent.

It is, therefore, a principal object of this invention to provide an improved exhaust system for a marine engine.

It is a further object of this invention to provide an exhaust system for a marine engine that embodies an under water exhaust gas discharge and which will insure against the ingestion of water into the engine chambers under any running condition.

SUMMARY OF THE INVENTION

This invention is adapted to be embodied in an exhaust system for a marine engine having at least a pair of alternative firing combustion chambers. First and second exhaust passages extend from respective of the chambers and terminate in a position that is beneath the water level under at least some running conditions of the associated watercraft. In accordance with the invention, means provide restricted communication between the first and second exhaust passages above the water level under those certain running conditions.

DETAILED DESCRIPTION OF THE PREFERRED EMBODIMENTS

Figure 1:
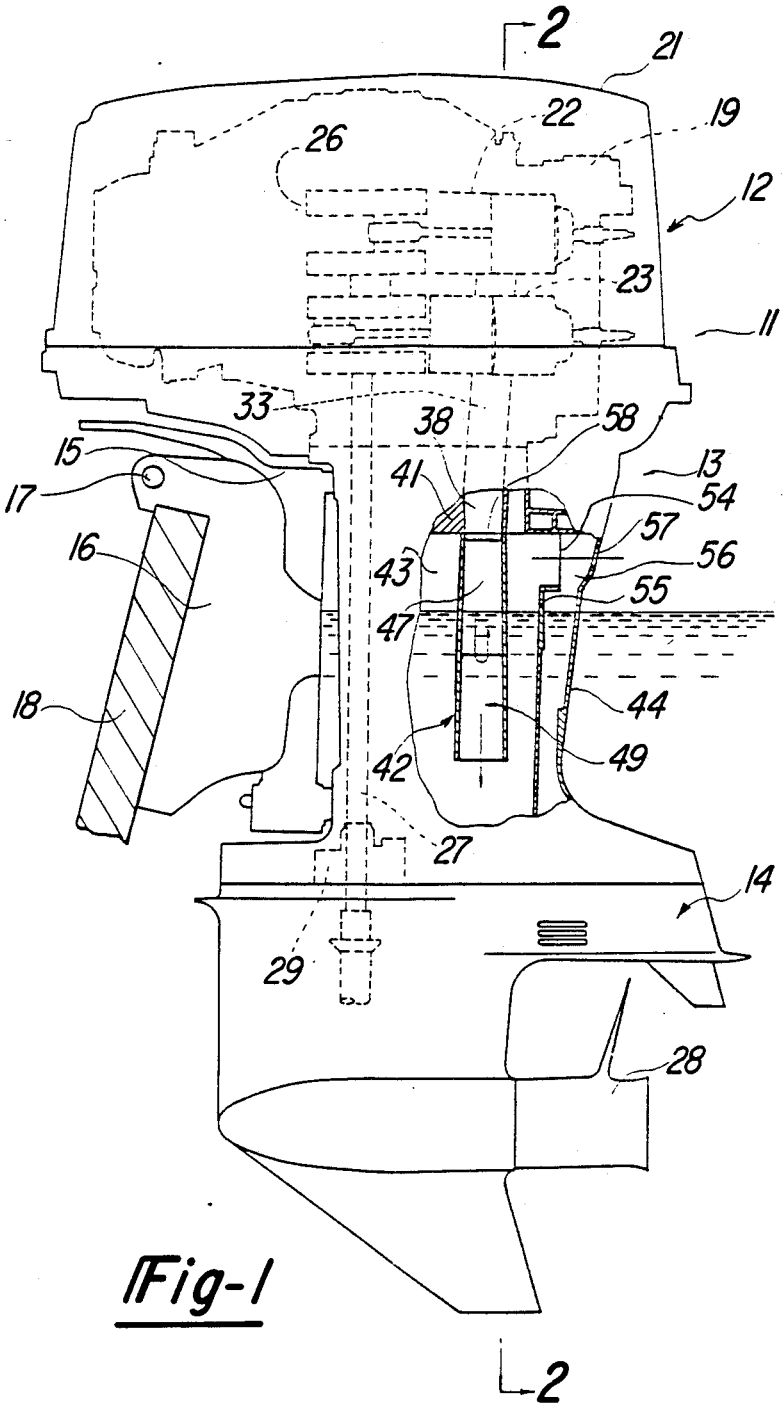
FIG. 1 is a side elevational view, with portions broken away, of an outboard motor constructed in accordance with a first embodiment of the invention and as attached to the transom of an associated watercraft. The figure illustrates the condition when running at low speeds or when idling.
Figure 2:
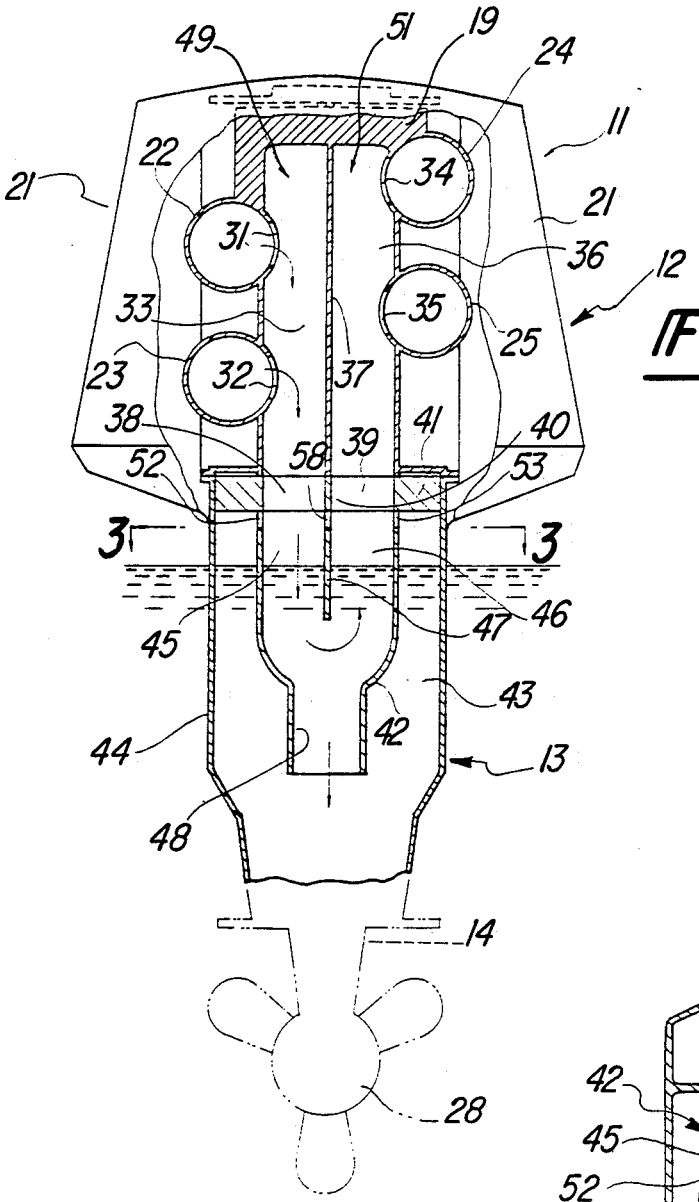
FIG. 2 is a rear elevational view, with portions broken away, of the outboard motor.
Figure 3:
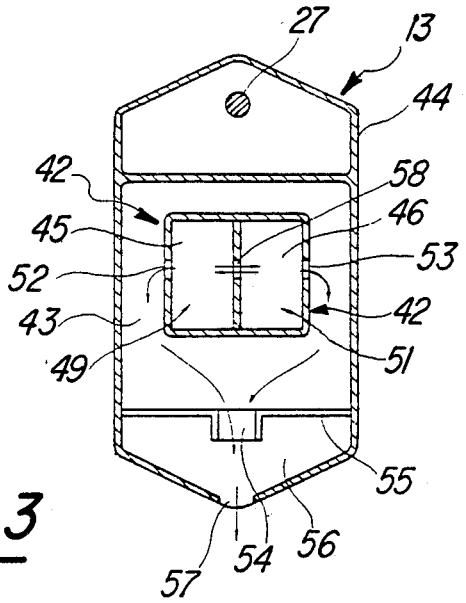
FIG. 3 is a cross-sectional view taken along the line 3—3 of FIG. 2.

Referring first to the embodiment of FIGS. 1 through 3, an outboard motor constructed in accordance with this embodiment is identified generally by the reference numeral 11. The outboard motor 11 is comprised of a power head, indicated generally by the reference numeral 12, a drive shaft housing, indicated generally by the reference numeral 13 and a lower unit 14. The drive shaft housing 13 is supported for steering movement about a generally vertically extending axis by means of a swivel bracket 15 in a known manner. The swivel bracket 15 is, in turn, pivotally connected to a clamping bracket 16 for pivotal movement about a horizontally extending tilt axis defined by a pivot pin 17. The clamping bracket 16 carries means for affixing the outboard motor 11 to a transom 18 of an associated watercraft.

The power head 12 includes an internal combustion engine 19 which, in the illustrated embodiment, is of the V4, two-cycle type. It is to be understood that the invention may be utilized in conjunction with engines of other types including four-cycle and non-reciprocating engines. However, the invention has particular utility in conjunction with engines having at least two alternately firing combustion chambers and particular utility in connection with two-cycle engines wherein there are large degrees of overlap between the intake and exhaust timing.

The engine 19 is surrounded by a protective cowling 21 which may be of any known type.

The engine 19, as has been noted, is of the V4 type and has a first bank containing cylinders 22 and 23 and a second bank containing cylinders 24 and 25. Pistons contained within the cylinders 22, 23, 24 and 25 are connected by means of connecting rods to drive a crankshaft 26 in a known manner. The crankshaft 26 rotates about a vertically extending axis and drives a drive shaft 27 that extends through the drive shaft housing 13 and into the lower unit 14. A suitable forward, neutral, reverse transmission (not shown) may be contained within the lower unit 14 for driving a propeller 28 in a known manner. The engine 19 is of the liquid cooled type and a water pump 29 is driven from the drive shaft 27 for delivering coolant to the engine 19 in a known manner.

Since the engine 19 is of the two-cycle type, the cylinders 22 and 23 are formed with respective exhaust ports 31 and 32. These exhaust ports communicate with an exhaust manifold 33 that is formed within a casting of the engine 19. In a similar manner, the cylinders 24 and 25 are provided with exhaust ports 34 and 35 that communicate with an exhaust manifold 36 formed in the same engine casting. The exhaust manifolds 33 and 36 are separated from each other by means of a dividing wall 37.

The lower ends of the exhaust manifolds 33 and 36 communicate with exhaust passages 38 and 39 formed in a spacer plate 41 that divides the engine 19 from the drive shaft housing 13 and which supports the engine 19 upon the drive shaft housing 13. The passages 38 and 39 in the spacer plate 41 are separated from each other by means of a dividing wall 40.

An exhaust pipe, indicated generally by the reference numeral 42 is contained within an expansion chamber 43 formed by an outer casing 44 of the drive shaft housing 13. The exhaust pipe 42 has a first exhaust passage 45 that communicates with the spacer plate ecxhaust passage 38 and a second exhaust passage 46 that communicates with the spacer plate exhaust passage 39. The exhaust pipe exhaust passages 45 and 46 are separated from each other by a dividing wall 47.

Below the dividing wall 47, the exhaust passages 45 and 46 communicate with each other and with an exhaust gas discharge opening 48 that discharges exhaust gases into the expansion chamber 43. It should be noted that when operating at high speeds, the associated watercraft raises in the water level and there will be no water in the area adjacent the exhaust gas discharge opening 48 so that there will be free communication between an exhaust passage, indicated generally by the reference numeral 49, and consisting of the exhaust manifold and passages 33, 38 and 45 and an exhaust passage 51 comprised of the exhaust manifold and passages 36, 39 and 46. The exhaust gases are discharged from the expansion chamber 43 under high speed running through an underwater exhaust gas discharge of any known type and which may include a through the hub propeller discharge.

When the watercraft is traveling at a low speed or when the engine 19 is idling, the watercraft and outboard motor 13 will become more deeply submerged in the body of water in which the outboard motor 11 is operating. Under this condition, the water level, as shown in FIGS. 1 and 2, will rise sufficiently so as to extend above the lower end of the partition 47 so that the exhaust passages 49 and 51 will no longer be in communication with each other. Under this condition, the water pressure is higher than the exhaust gas pressure and an above the water exhaust gas discharge is provided for this running condition which will now be described.

The exhaust pipe 42 is provided with a pair of restricted openings 52 and 53 which communicate the exhaust passages 45 and 46 with the expansion chamber 43 at a point above the water level and close to the spacer plate 41. Thus, exhaust gases may flow from the exhaust passages 49 and 51 into the expansion chamber 43 at slow speeds through the restricted openings 52 and 53. These exhaust gases then pass through an opening 54 formed in a partition 55 of the drive shaft housing 44 into a further expansion chamber 56. From the expansion chamber 56, the exhaust gases may be discharged to the atmosphere through an above the water slow speed exhaust gas discharge 57. It should be noted that the slow speed exhaust gases are silenced by passing through the restricted openings 52 and 53, expanding in the expansion chamber 43, again flowing through a restricted passageway 54 and expanding in the expansion chamber 56 and subsequently passing to the atmosphere through the restricted opening 57.

It has been noted that the cylinders 22, 23, 24 and 25 fire alternatively. Because of this, there will be times when the pressure in the exhaust passages 49 and 51 are less than atmospheric pressure. This is a result of the overlap between the inlet and exhaust porting of the engine 19, as is well known. With the construction as thus far described, this negative pressure in the exhaust passages 49 and 51 could cause water to be drawn up through these exhaust passages and enter back into the engine cylinders through the exhaust ports 31, 32, 34 and 35. The same phenomenon can also occur when one engine is exhausting as the increased pressure can cause the water level to rise in the other exhaust passage and enter the cylinders. This can be harmful to the engine, as should be readily apparent.

In order to avoid these possibilities, a restricted communication is provided between the exhaust passages 49 and 51 at a location that will be above the water level under all running conditions. This may be conveniently done in the illustrated embodiment by terminating the dividing wall 47 of the exhaust pipe 42 at a spaced location from the spacer plate 41 so as to provide a restricted communicating passageway 58. It should be noted that the firing order of the engine is such that only one of the exhaust passages 49 and 51 will be below atmospheric pressure at any given instant. Thus, this lower pressure exhaust passage may draw air from the other exhaust passage through the restricted opening 58 to insure that water will not be drawn up into the engine cylinders.

Figure 4:
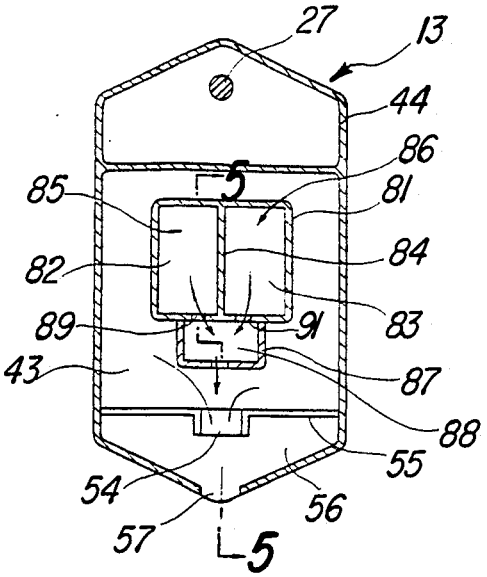
FIG. 4 is a cross-sectional view, in part similar to FIG. 3, showing another embodiment of the invention.
Figure 5:
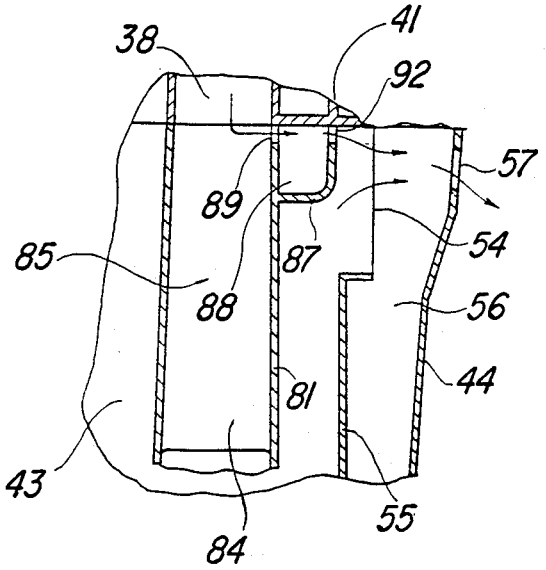
FIG. 5 is a cross-sectional view taken along the line 5—5 of FIG. 4.

In the embodiment of the invention thus far described (FIGS. 1 through 3), the individual exhaust gas passages 49 and 51 communicated with the slow speed above the water exhaust gas independently of each other. FIGS. 4 and 5 show an embodiment of the invention wherein the exhaust passages communicate with the slow speed exhaust gas discharge through a common expansion chamber thus eliminating the necessity for providing the separate communicating passageway 58. Certain elements of the embodiment of FIGS. 4 and 5 are the same as the previously described embodiment and where this is the case, those elements have been identified by the same reference numerals and will not be described again in detail.

In this embodiment, an exhaust pipe, indicated generally by the reference numeral 81 has a pair of exhaust gas passages 82 and 83 which communicate with their upper ends with the exhaust gas passages of the spacer plate 41 and the exhaust manifolds (not shown) of the associated engine 19 in the manner previously described. The exhaust passages 82 and 83 are separated from each other by means of a dividing wall 84 that extends from the spacer plate 41 downwardly to a point adjacent the exhaust gas discharge which is not shown but which is the same as in the previously described embodiment. Hence, a pair of separate exhaust gas passages 85 and 86 are formed that communicate with alternately firing cylinders of the engine.

In this embodiment, the exhaust pipe 81 has a rearwardly extending projection 87 that defines and expansion chamber 88 that extends along the rear edges of both of the exhaust passages 82 and 83. The exhaust passages 82 and 83 communicate with the expansion chamber 88 by means of a pair of restricted openings 89 and 91. These openings 89 and 91 are positioned closely adjacent each other, as may be seen in FIG. 4, and because of this and their common communication with the expansion chamber 88, there is restricted communication between the exhaust passages 85 and 86. This restricted communication will prevent water from being drawn back into the engine cylinders under all running conditions.

The exhaust gases are discharged from the expansion chamber 88 into the expansion chamber 43 through a restricted opening 92. From there, the exhaust gases are discharged into the expansion chamber 56 through the opening 54 and then to the atmosphere through the opening 57 as with the previously described embodiment.

It should be readily apparent from the foregoing description that a highly effective exhaust system has been illustrated and described which permits exhaust gas silencing under all running conditions and also which will insure against ingestion of water back into the engine cylinders under any running conditions. Although two embodiments of the invention have been illustrated and described, various changes and modifications may be made without departing from the spirit and scope of the invention, as defined by the appended claims.

What is claimed:

1. An exhaust system for a marine engine having at least a pair of alternate firing combustion chambers, a first exhaust passage extending from one of said chambers and terminating in a position that is below the water level under at least some running conditions of the associated watercraft, a second exhaust passage extending from another of said chambers and terminating in a position that is beneath the water level under at least some running conditions of the associated watercraft, means providing restricted communication between said first and said second exhaust passages above the water level under said certain running conditions for permitting gas to flow from one of said exhaust passages into the other of said exhaust passages in the event a negative pressure is created in said other exhaust passage for preventing water from being drawn into the combustion chamber communicating with said other exhaust passage, said exhaust passages communicate with an under water exhaust for high speed exhaust gas discharge under the water, and an above the water exhaust with which said exhaust passages communicate for above the water exhaust gas discharge when operating under the certain running conditions.

2. An exhaust system as set forth in claim 1 wherein the exhaust passages communicate with the above the water exhaust independently of each other.

3. An exhaust system as set forth in claim 2 wherein the exhaust passages are formed in part by an exhaust pipe having a dividing wall defining parallel first and second exhaust gas passages, the restricted opening being formed in said dividing wall and the communication of the exhaust passages with the above the water exhaust comprising restricted openings extending through outer walls of said exhaust pipe.

4. An exhaust system as set forth in claim 1 wherein the exhaust passages communicate with the above the water exhaust through a common expansion chamber for providing the restricted communication therebetween.

5. An exhaust system as set forth in claim 4 wherein the exhaust passages are formed in part by an exhaust pipe having a dividing wall defining parallel first and second exhaust gas passages, the common expansion chamber being formed by said exhaust pipe and said passages communicating with the common expansion chamber through respective restricted openings positioned contiguous to each other.

* * * * *